United States Patent [19]

Cassel

[11] Patent Number: 4,915,238

[45] Date of Patent: Apr. 10, 1990

[54] STACKABLE SHOE RACK

[75] Inventor: Timothy S. Cassel, Boxborough, Mass.

[73] Assignee: Tucker Housewares, Leominster, Mass.

[21] Appl. No.: 235,034

[22] Filed: Aug. 22, 1988

[51] Int. Cl.[4] ..... A47F 7/08

[52] U.S. Cl. ..... 211/37; 211/189; 211/194

[58] Field of Search ..... 211/34, 37, 194, 189, 211/188

[56] References Cited

U.S. PATENT DOCUMENTS

| | | | |
|---|---|---|---|
| 2,836,306 | 5/1958 | Einhorn | 211/189 |
| 2,943,741 | 7/1960 | Atkinson | 211/37 |
| 2,969,155 | 1/1961 | Atkinson | 211/37 X |
| 3,974,917 | 8/1976 | Waxmanski | 211/188 X |
| 4,444,320 | 4/1984 | Chap | 211/194 X |

FOREIGN PATENT DOCUMENTS

| | | | |
|---|---|---|---|
| 1428114 | 3/1976 | United Kingdom | 211/37 |

*Primary Examiner*—Robert W. Gibson, Jr.
*Attorney, Agent, or Firm*—Darby & Darby

[57] ABSTRACT

A shoe rack formed of identical end pieces and identical shoe holding cross pieces which have integral connectors. The end pieces have legs with a foot which is to rest on the supporting surface or which stacks a rack on top of another rack of similar construction. The end pieces accept and hold the cross pieces at selected locations so that the cross-pieces of stacked racks can be offset, or staggered, from each other to permit ready access to the shoes on a lower rack.

12 Claims, 3 Drawing Sheets

STACKABLE SHOE RACK

BACKGROUND OF THE INVENTION

The present invention relates to a shoe rack which can be easily assembled and is stackable in tiers of such racks, i.e., two or more racks stacked one above the others to provide a large capacity shoe storage in a minimum amount of space.

Various types of shoe racks have been used for a number of years. Many of these are of metal construction, for example typical ones being shown in U.S. Pat. No. 1,428,114 and Cohen U.S. Pat. No. 2,695,106, in which the racks are made of metal and have end pieces to which shoe holding cross pieces are attached by external connectors, such as nuts and bolts. In addition to requiring external connectors, these racks are not readily stackable. Other metal racks such as in Stein U.S. Pat. No. Des. 165,942; Einhorn U.S. Pat. Nos. 2,815,862 and 2,836,306 and in Neuwirth U.S. Pat. No. 2,928,549 use various types of fittings but such racks often require pieces to be welded, etc.

A plastic shoe rack which is made of identical pieces of material which are interlocked together by integrally formed connectors is shown in U.S. Pat. No. 4,463,853 to Licare et al and in U.S. Pat. No. Des. 270,118 to Wood. Such a shoe rack, being of pyramidal shape is nestable, i.e., one can be placed inside the other for purposes of display or storage. This accomplishes nothing from the point of view extending shoe storage capacity since, upon stacking, much of the storage function is lost by one pyramidal rack covering the other.

BRIEF DESCRIPTION OF THE PRESENT INVENTION

The present invention relates to a shoe rack which is formed of molded plastic pieces, having integral connector elements to eliminate the need for external fasteners such as nuts and bolts. Such integral connector elements are formed in the end pieces of the rack which are to rest on a base surface or be stacked on another rack. The rack also has a plurality of cross members which hold the shoes, the cross members being connected to and between a pair of end pieces. In addition, an arrangement is provided for stacking assembled racks, one above the other by using specially formed feet on the legs of the end pieces which interlock with the end pieces of the rack below it. The shoe rack of the invention is also configured so that the cross pieces can be connected to the end pieces of the rack at selected locations so that the location of the shoe holding cross pieces on an upper level rack in a stack of several racks can be selected so as to provide access from the top rack of the stack to the interior of a lower rack.

OBJECTS OF THE INVENTION

It is an object of the present invention to provide a shoe rack formed of end supporting pieces to which shoe holding cross pieces are connected, with the various pieces having integral connecting members.

An additional object is to provide a stackable shoe rack having sections which can be stacked one above the other.

A further object is to provide a tier type shoe rack stacking arrangement in which the end pieces of a rack has legs with feet which permit the rack to be attached to and stacked on the end pieces of a lower rack of the tier.

Another object is to provide a shoe rack with end pieces and shoe holding cross members having integral connectors, in which a plurality of selectable connecting locations are provided for attaching the cross-pieces to the end pieces.

Still a further object is to provide a stackable shoe rack arrangement wherein the end pieces and the cross piece of all of the racks are of the same construction and the end pieces can accept and hold the cross pieces at staggered selected locations to provide access to the shoes on the lower rack.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
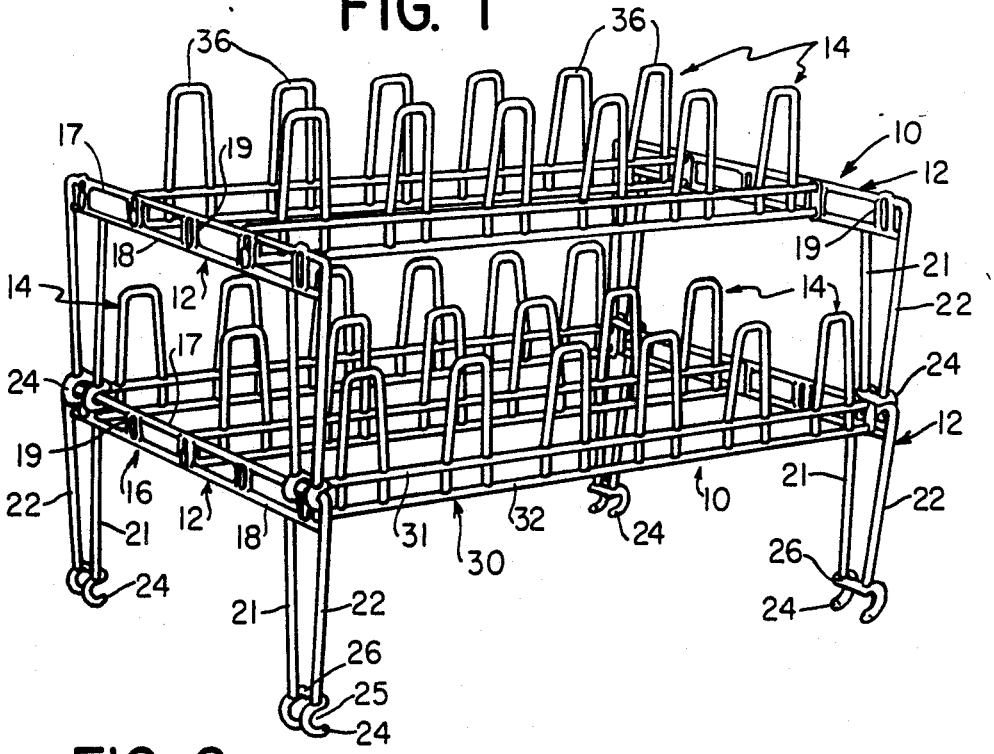
FIG. 1 is a perspective view of a shoe rack in accordance with the invention with two such racks being stacked one above the other.
Figure 2:
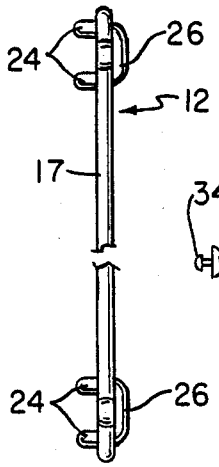
FIG. 2 is a top view of one of the end pieces.
Figure 3:
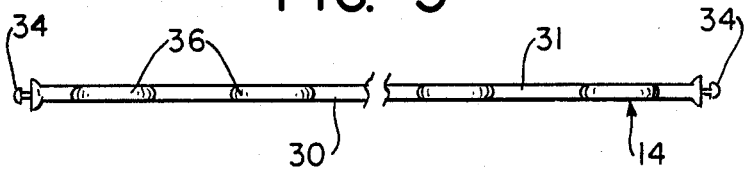
FIG. 3 is a top view of one of the cross pieces.

Referring to the drawings, the shoe rack 10 of the present invention is formed by two end pieces 12 of identical construction. There are a plurality of shoe holding cross pieces 14, each of which is also of an identical construction, mounted between two end pieces 12. Thus, there are only two different types of pieces for the entire assembled shoe rack.

Each of the end pieces and cross pieces is of open wire or open frame type construction and is preferably made by molding from a suitable plastic material such as ABS, polypropylene, etc. The lengths and heights of the end pieces 12 and cross pieces 14 can be selected as desired, it being understood that the larger each piece is made, the stronger it must be since more shoes would be supported. Typical dimension would be a 17" long and 8½" high for the end pieces 12 and 25¼" long for the cross pieces 14.

Figure 4:
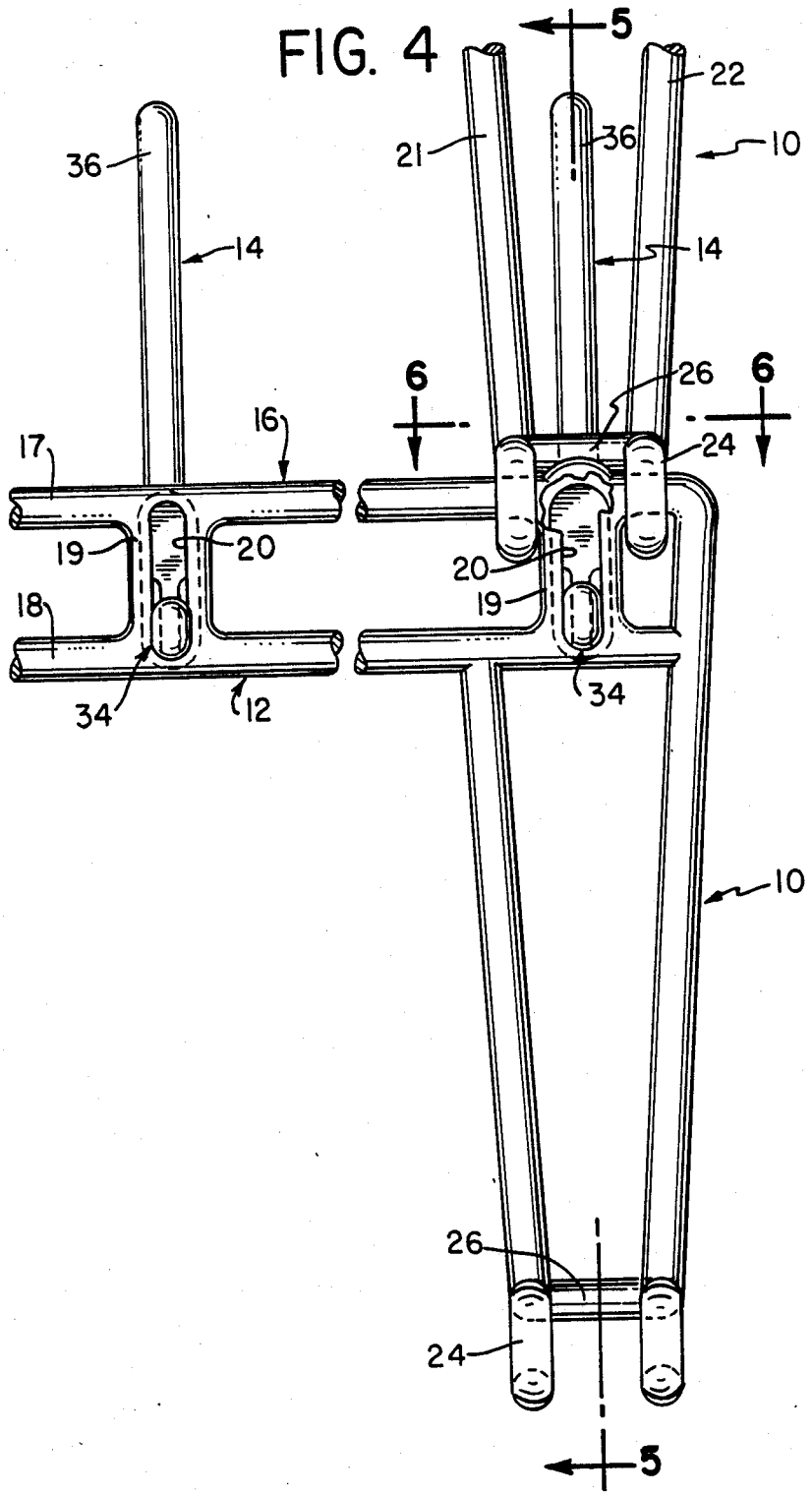
FIG. 4 is an enlarged view showing both the fastening of the end piece to the cross pieces; and also the stacking arrangement of one of the rack supports.
Figure 7:
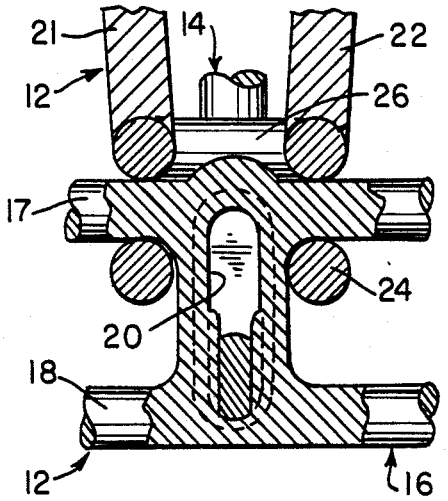
FIG. 7 is an enlarged sectional view taken along the line 7—7 of FIG. 5.

Each of the end pieces 12 has an upper frame portion 16 with upper and lower horizontal rails 17 and 18. The upper and lower rails 17, 18 are connected together by a number of pairs of vertically extending cross-struts 19, each of the pairs of cross-struts having an open, generally oval shaped channel 20, (FIGS. 4 and 7) therebetween. The strut pairs and their channels 20, as described in greater detail below, also serve as fastening means for the shoe holding cross pieces.

As seen in FIG. 1, there are five pairs of struts 19, one adjacent each end of each of the frame portions 16 spaced from a downwardly extending leg at each end of the cross piece and three strut pairs which are more or less evenly spaced relative to the ends of the frame 16. A shoe holding cross-piece 14 can be held between corresponding pairs of struts on the opposing end pieces 11 which form the shoe rack. The number of pairs of cross-struts 19 and their exact location along the frame 16 of the end pieces can be selected as desired.

Figure 5:
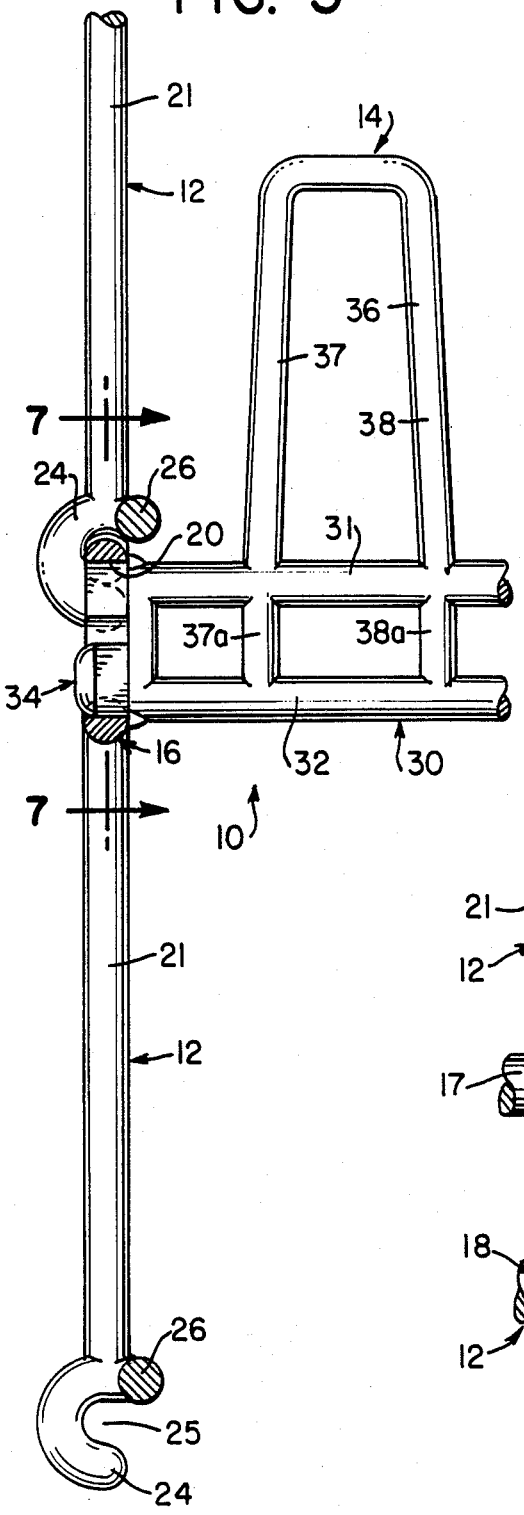
FIG. 5 is an enlarged sectional view taken along lines 5—5 of FIG. 4.
Figure 6:
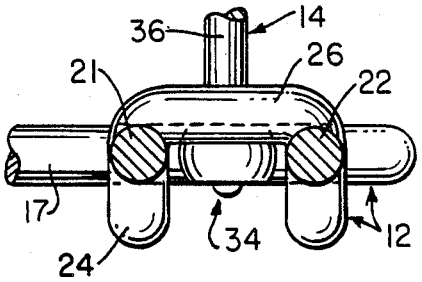
FIG. 6 is an enlarged sectional view taken along the lines 6—6 of FIG. 4.

Each of the end pieces 12 also has a downwardly extending leg at each end of frame 16 which is formed by two spaced, generally vertical rails 21 and 22. The leg rails 21, 22 taper inwardly somewhat in a generally V-shape and terminate in a foot 24 at the bottom of the leg. A cross bar 26 joins the two leg rails 21 and 22 at the beginning of the foot 24. Thereafter proceeding downwardly, each of the rails 21 and 22 at the foot 24 is curved in a generally C-shaped configuration defining an open pocket 25, (FIGS. 1 and 5). The C configuration is not entirely symmetrical. That is, (see FIG. 5) the ends of the leg rail pieces 21 and 22 meet the top of the C spaced outwardly from the cross bar 21. The lower part of the C, which rests on the ground or base on which the rack is to be located, terminates, inwardly of the cross-bar 26, substantially in-line vertically with the vertical leg rails 21, 22.

Each of the cross pieces 14 is formed of to have a support frame 30 including upper and lower horizontal rails 31 and 32 which extend the length of the cross piece 14. Extending across the rails 31, 32 to join them together, and extending upwardly from the upper cross-piece rail 31 are a number of generally V-shaped shoe supports 36, six of these illustratively being shown. As shown in FIGS. 1 and 5, each shoe support 36 is formed by two upwardly extending legs 37, 38 which taper inwardly. Extensions 37*a*, 38*a* of the legs between the two horizontal cross-piece frame rails 31, 32 join and hold the rails together.

Each cross piece 14 is preferably essentially a planar structure, i.e., it is flat and there are no extensions outwardly from the upper and lower rails 31, 32. If desired, however, the shoe supports 36 can be canted or tilted outwardly from the frame pieces 31, 32.

Each end of each cross piece support frame 30 has an outwardly extending locking bayonet connector 34 which fits into a channel 20 of the end piece 12. The bayonet connecter 34 can fit into an end piece channel 20 from either side of the end piece. To connect cross pieces 14 to the end pieces 12, the bayonet connector 34 of the cross piece is inserted into the channel slot 20 of the end piece and downward pressure is applied. There is a force fit which provides a secure engagement. This is done for each of the ends of each of the cross pieces 14 used. As many of the cross pieces 14 can be assembled as desired, however, it takes at least two to provide adequate stability for the shoe rack.

As seen in FIG. 1, there are three cross pieces 14 assembled to the two end pieces 12 of the lower rack, one cross piece to the channel 20 of the cross-strut pair 19 adjacent each end of the end piece and another to the center cross-strut pair strut 19.

The assembled lower shoe rack of FIGS. 1 has its curved foot 24 at each end of each of the two end pieces resting on the base surface. In FIG. 1, the open part of the C is shown as facing inwardly of the assembled rack but the open faces can face outwardly. The three cross pieces 14 connect the two end pieces together form a stable structure.

A single shoe rack of the present invention is fully functional. Up to five shoe holding cross pieces 14 can be used in the illustrative embodiment shown although the length of the end pieces 12 can be extended or reduced to accommodate more or fewer cross-pieces and to vary the spacing between the cross pieces so that shoes can be mounted on adjacent cross-pieces without interferences. To accomplish the latter when using a five shoe holding cross-pieces, the end pieces 12 would have to be relatively long thereby making the overall size of the rack large.

With the present invention, it is possible to stack two or more tiers of shoe racks to obtain additional storage capacity while using only a modest amount of floor space. This can be done without the use of any additional connectors or stabilizing pieces. The various FIGS. 1 and 4–7 illustrate how this is done. Here, the second (upper) shoe rack 50 is assembled in the same manner as described with respect to the first (lower) shoe rack. The pocket 25 of the curved foot 24 of each of the legs of the end pieces 12 of the upper rack is placed over the upper frame rail 17 of the end piece of the lower rack. Here also, the open pocket 25 of the upper rack can be used facing either inwardly as shown or outwardly. The spacing between the two rails 21, 22 at the curved foot 24 of each leg is sufficient to permit one of the cross-strut pairs 19 to fit between the two legs.

As seen in FIG. 5, the top frame rail 17 of an end piece rests within the foot pocket 25 and is vertically directly below the vertical rails 21, 22 of the legs of the upper rack. This provides good stability since downward weight and force on the vertical leg rails 21, 22 of the legs of the upper rack will be distributed directly to the upper horizontal rail 17 of the end piece 12 of the lower rack. The cross bar 26 across the rails 21, 22 of the foot 24 rests against the upper rail 17 of the end piece on the lower rack. This also permits the weight on the upper rack to be more evenly distributed to the lower rack.

As seen in FIG. 1, only three cross pieces 14 are used on the lower rack with two at the ends and one at the center of the two end pieces. The upper rack has the cross pieces 14 at the cross-strut pairs 19 which are not used on the lower rack, i.e., are in from the end. This provides access to the shoes which are stored on the three cross-pieces of the lower rack. As seen the selectable locations for the cross pieces 14 permit stackable racks to be made of the same pieces but permits a variation of the location of the cross pieces to provide access to the shoes on both racks.

If desired, a third rack can be stacked on the second tier. However, if this is done, access to the shoes on the other racks would be difficult.

As can be seen, a novel shoe rack of relatively simple and economical construction is provided. No external connectors are needed. A stackable arrangement is also obtained without using any additional components and also without making one tier of the rack of different pieces than the other or requiring any other connecting parts. That is, all of the components of the stackable shoe rack in the present invention can be made with two molds, one for the end pieces, since all of the end pieces are the same, and the other for the cross pieces, since all of the cross pieces are the same.

While the rack has been described for holding shoes, it should be understood that other articles can be held, for example, boots, gloves for drying, etc.

I claim:

1. An article holding rack comprising:

a pair of end members of identical construction, each of said end members having:

a. an elongated mounting frame which is to be located generally horizontally;

b. a downwardly extending leg at each end of the mounting frame, each leg having a curved foot portion defining an open pocket and whose bottom extremity is to rest on a supporting surface, the open pocket of the curved foot adapted to fit over a part of another mounting frame, c. a plurality of integral fastening means spaced across the length of the mounting frame and integral therewith, at least one elongated cross piece for extending between the two end members in a vertical orientation, said cross piece having a plurality of upwardly extending article holding members, and an integral fastener at each end of a said cross-piece to mate with a fastening means of a said end member to connect the cross-piece to said two end members.

2. An article holding rack as in claim 1 wherein said integral fastener of a cross-piece is substantially in the same plane as the other parts of said cross-piece.

3. An article holding rack as in claim 1 wherein said fastening means of the mounting frame of the end members extend generally vertically.

4. An article holding rack as in claim 1 wherein the fasteners at the ends of a cross-piece are adapted to be pushed downwardly into said fastening means of said mounting members.

5. An article holding rack as in claim 4 wherein said integral fastener of a cross-piece is substantially in the same plane as the other parts of said cross-piece.

6. An article holding rack as in claim 5 wherein the fasteners at the ends of a cross-piece are adapted to be pushed downwardly into said fastening means of said mounting member.

7. An article holding rack as in claim 1 wherein said mounting frame of said end pieces is formed by a pair of spaced rails, and a plurality of spaced support members connecting said spaced rails and including a said fastening means.

8. An article holding rack as in claim 4 wherein said support members connecting the spaced rails comprise a pair of spaced struts defining the fastening means therebetween.

9. An article holding rack as in claim 7 wherein said fastening means of a support member comprises an eccentrically formed opening into which a cross-piece fastener is inserted and connection is provided by forcing the cross-pieces downwardly relative to the mounting frame.

10. An article holding rack as in claim 1 wherein said mounting frame of said end pieces is formed by a pair of spaced horizontal rails, and a plurality of pairs of spaced support cross-struts connecting said rails, a support cross-strut pair including said fastening means, said pocket of said curved foot of another rack adapted to fit over the top horizontal rail of said spaced rails.

11. An article holding rack as in claim 10 wherein said foot comprises a pair of spaced rails and a cross-strut pair of the mounting frame on which the foot rests fits between the spaced rails of a foot.

12. An article holding rack as in claim 11 further comprising a cross-bar between the rails forming a foot and adapted to rest on the top rail of the support frame of a lower rack.

* * * * *